US007775226B2

(12) United States Patent
MacDonald et al.

(10) Patent No.: US 7,775,226 B2
(45) Date of Patent: Aug. 17, 2010

(54) UMBRELLA

(75) Inventors: Erin MacDonald, Ann Arbor, MI (US); Njemile Vinson, Laurel, MD (US); Tony Koenigsknecht, Royal Oak, MI (US); Marc Uphues, Ann Arbor, MI (US)

(73) Assignee: Crayella, Inc. MI (US)

( * ) Notice: Subject to any disclaimer, the term of this patent is extended or adjusted under 35 U.S.C. 154(b) by 84 days.

(21) Appl. No.: 12/013,982

(22) Filed: Jan. 14, 2008

(65) Prior Publication Data

US 2008/0210281 A1 Sep. 4, 2008

Related U.S. Application Data

(60) Provisional application No. 60/884,884, filed on Jan. 14, 2007.

(51) Int. Cl.
*A45B 25/02* (2006.01)

(52) U.S. Cl. ..... 135/31; 135/29; 135/32

(58) Field of Classification Search ..... 135/27–32; 211/197, 119.01

See application file for complete search history.

(56) References Cited

U.S. PATENT DOCUMENTS

| | | | | |
|---|---|---|---|---|
| 1,289,334 | A * | 12/1918 | Whitcoo | 135/31 |
| 4,368,749 | A * | 1/1983 | Lindler et al. | 135/15.1 |
| 5,235,997 | A * | 8/1993 | Good | 135/25.3 |
| 5,345,960 | A * | 9/1994 | Tung | 135/32 |
| 5,433,233 | A * | 7/1995 | Shiran et al. | 135/20.1 |
| 5,715,853 | A * | 2/1998 | Lin | 135/29 |
| 5,746,235 | A * | 5/1998 | Lin | 135/29 |
| 6,053,188 | A * | 4/2000 | Walker | 135/26 |
| 6,173,723 | B1 * | 1/2001 | Wang | 135/31 |
| 7,246,629 | B2 * | 7/2007 | You | 135/29 |
| 2006/0185701 | A1 * | 8/2006 | Chen et al. | 135/31 |
| 2009/0000650 | A1 * | 1/2009 | Li | 135/25.31 |

FOREIGN PATENT DOCUMENTS

JP 08173223 A * 7/1996

* cited by examiner

*Primary Examiner*—Winnie Yip
(74) *Attorney, Agent, or Firm*—Jeffrey Schox

(57) ABSTRACT

The umbrella of the preferred embodiments includes a shaft, a canopy, and a spoke system, coupled to the shaft and to the canopy, which supports the canopy and provides a mechanism to open and close the canopy. The spoke system of the preferred embodiments includes a canopy spoke, coupled to the shaft and to the canopy, having a geometry that defines a canopy coupling element; a support spoke, coupled to the shaft and to the canopy spoke, having a geometry that defines a support coupling element; and a first release mechanism that includes the canopy coupling element and the support coupling element. The umbrella 10 is preferably designed to prevent the passage of precipitation or sun and, more specifically, designed to be an umbrella that can be easily assembled, disassembled, repaired, and recycled. The umbrella 10, however, may be alternatively used in any suitable environment and for any suitable reason.

23 Claims, 4 Drawing Sheets

UMBRELLA

CROSS-REFERENCE TO RELATED APPLICATIONS

This application claims the benefit of U.S. Provisional Application No. 60/884,884, filed 14 Jan. 2007, which is incorporated in its entirety by this reference.

TECHNICAL FIELD

This invention applies to the field of umbrellas and more specifically, to an umbrella that is easily assembled, disassembled, repaired, and recycled.

BACKGROUND

Conventional umbrellas break and bend easily and are typically manufactured to be replaced, instead of repaired, reused, or recycled. Thus there is a need in the umbrella field for a new and useful improved umbrella that is stronger and more resilient than conventional metal-framed umbrellas and that can be rapidly assembled (preferably without tools), easily repaired (preferably by the consumer), and easily recycled. This invention provides such a new and useful umbrella.

DESCRIPTION OF THE PREFERRED EMBODIMENT

The following description of the preferred embodiments of the invention is not intended to limit the invention to this preferred embodiment, but rather to enable any person skilled in the art to make and use this invention.

Figure 1:
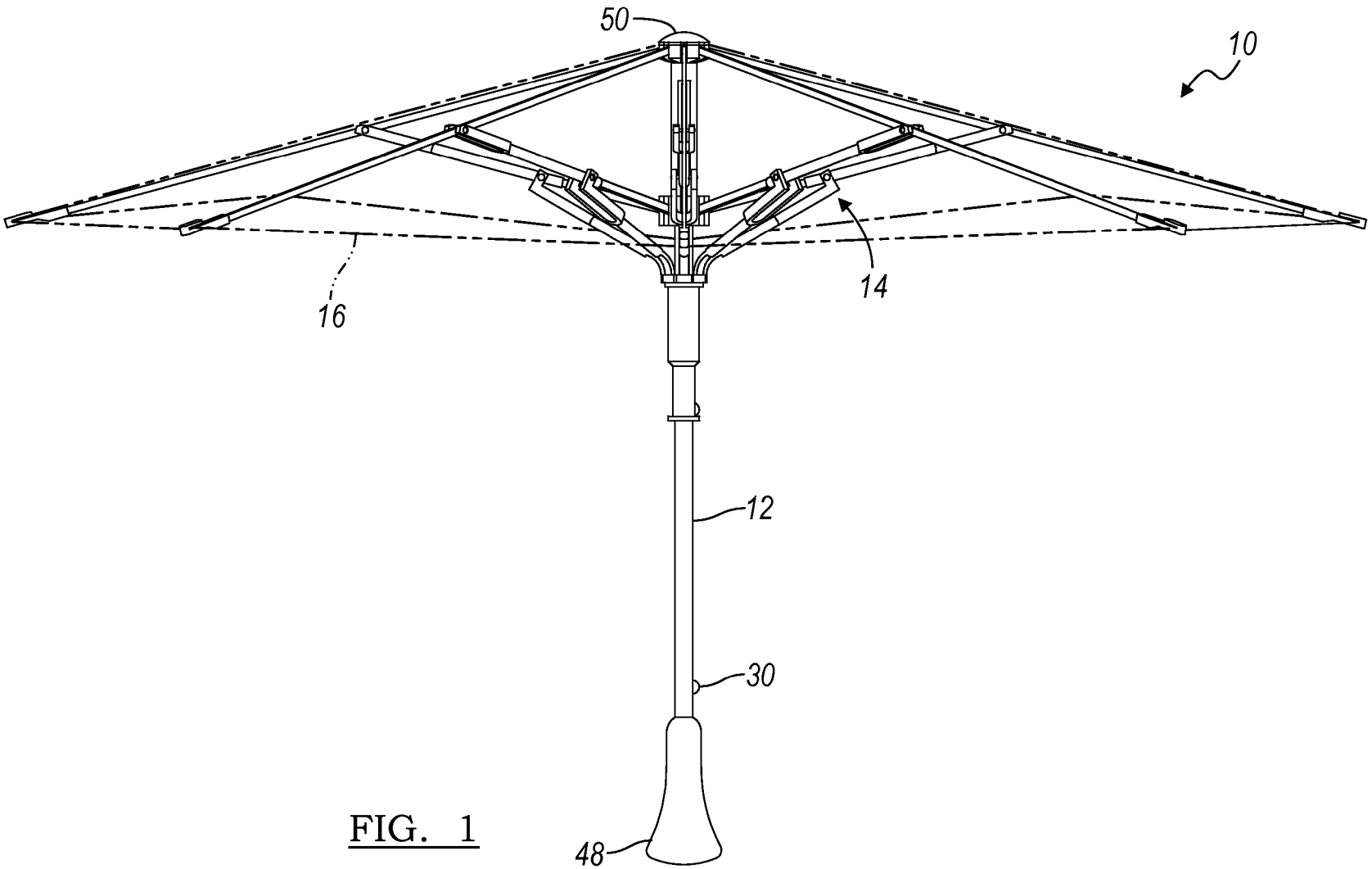
FIG. 1 is a drawing of the umbrella of the preferred embodiment.

As shown in FIG. 1, the umbrella 10 of the preferred embodiments includes a main shaft 12, a spoke system 14 connected to the main shaft 12 to provide a support structure and a mechanism to open and close the umbrella 10, and a canopy 16 connected to the main shaft 12 and to the spoke system 14 to prevent the passage of precipitation or sun. The umbrella 10 is preferably designed to prevent the passage of precipitation or sun and, more specifically, designed to be an umbrella that is easily assembled, disassembled, repaired, and recycled. The umbrella 10, however, may be alternatively used in any suitable environment and for any suitable reason.

1. Main Shaft

The main shaft 12 of the preferred embodiments functions to support the elements of the umbrella 10. In a first variation, the main shaft 12 is preferably generally straight and rigid. The main shaft 12 preferably has a circular cross section, but may alternatively have any suitable cross section geometry. The main shaft 12 is preferably made of recycled polypropylene plastic, but may be alternatively made from any plastic, metal, wood, or any other suitable material. The main shaft 12 preferably includes a rod that provides additional structural support. The rod is preferably generally straight and rigid and may be located concentrically within the main shaft 12. The rod is preferably made of recycled aluminum, but may be alternatively made from any plastic, metal, wood, or any other suitable material. The rod is preferably connected to the main shaft 12 through a snap fit, press fit, or though any other suitable connection. The rod is preferably removable for repair, upcycling, and/or recycling. The main shaft 12 and rod may be any suitable geometry, material, and may be connected in any suitable manner to support the elements of the umbrella 10.

Figure 2:
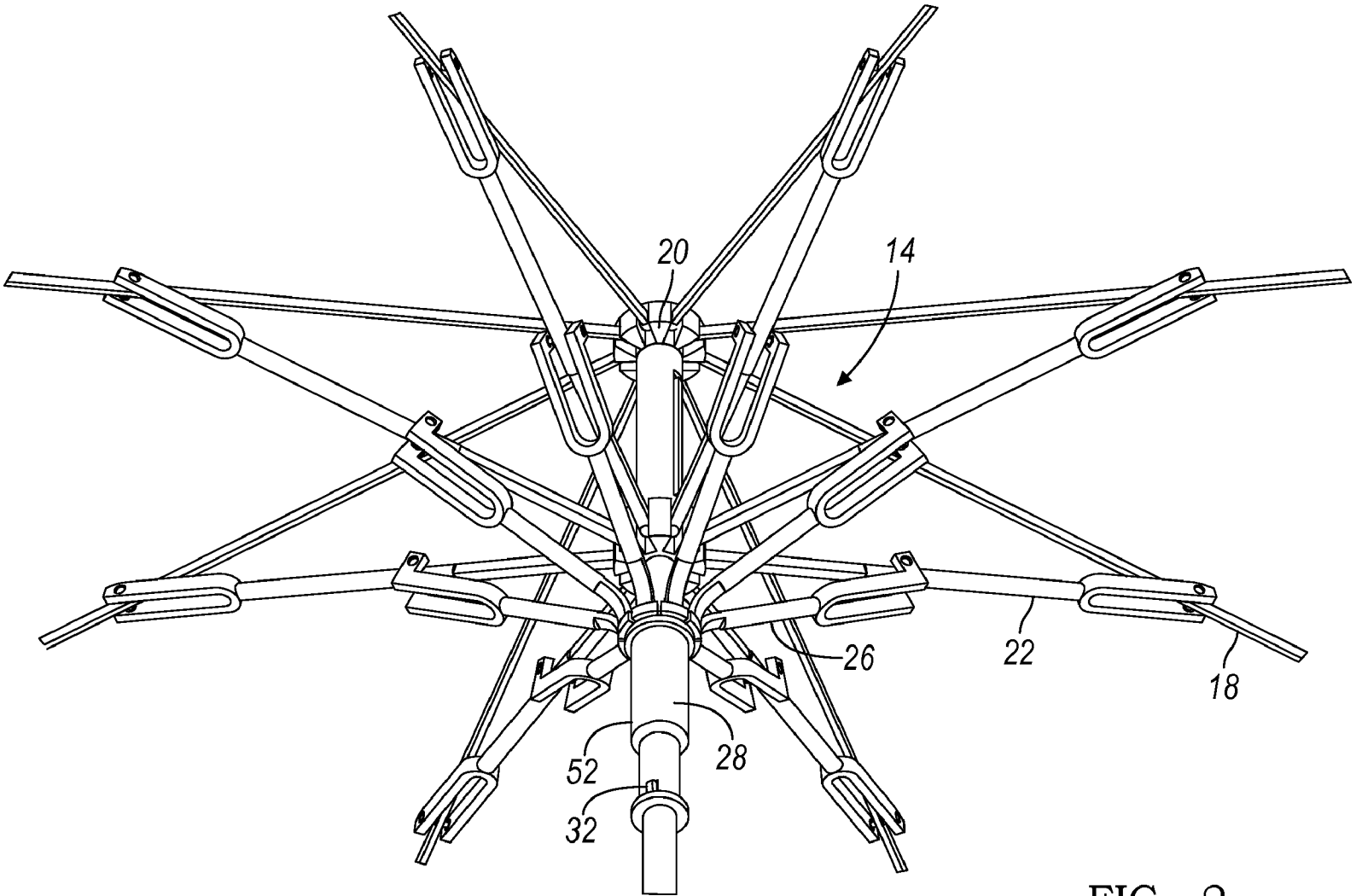
FIG. 2 is a drawing of a first variation of the spoke system, the canopy spoke spindle, and the spring spoke spindle, of the umbrella of the preferred embodiment.

The main shaft 12 preferably includes at least one latch that functions to hold the spoke system 14 in the open position and/or the closed position. The main shaft 12 of the preferred embodiments, as shown in FIGS. 1 and 2, includes a first latch 30 that functions to hold the spoke system 14 in the closed position and a second latch 32 that functions to hold the spoke system 14 in the open position. The first latch 30 is preferably located on the portion of the main shaft 12 towards the bottom portion of the main shaft 12, and the second latch 32 is preferably located on the portion of the main shaft 12 towards the top portion of the main shaft 12 and the canopy 16. The main shaft 12 may alternatively include only one latch or more than two latches. The first latch 30 and second latch 32 are preferably one of several variations. In a first variation, the first latch 30 and second latch 32 include a spring loaded latch mechanism or compliant spring-like component with a button portion extending beyond the main shaft 12. The button portion functions to catch on a spoke spindle of the spoke system 14. The button portion is spring loaded such that and it may be compressed into the main shaft 12 such that the outermost portion of the button portion is flush with the main shaft 12. When the button portion is extended it catches on the spoke spindle, and when the button portion is compressed into the main shaft 12, the spoke spindle may slide past the button portion, and transition the umbrella to the open position from the closed position or vice versa. The button portion preferably has a geometry such that as the spoke spindle comes in contact with the button portion and begins to apply a force on the button portion, the geometry of the button portion will guide the spoke spindle over the button portion, forcing the button portion to compress into the main shaft 12. The button portion may alternatively have any other suitable geometry. The first latch 30 and second latch 32 may alternatively be any suitable latch to hold the spoke system 14 in the closed position and the open position respectively.

2. Spoke System

As shown in FIG. 2, the spoke system 14 of the preferred embodiments functions to provide a support structure and a mechanism to open and close the umbrella 10. The spoke system 14 includes at least one of a canopy spoke system, a support spoke system, and a spring spoke system. The elements of the spoke system are preferably made of recycled polypropylene plastic, but may be alternatively made from any plastic, metal, wood, or any other suitable material.

2a. Canopy Spokes

As shown in FIG. 2, the canopy spoke system of the preferred embodiments functions to support the canopy 16 and hold the canopy 16 taught in the open position and folded in the closed position. The canopy spoke system includes at least one canopy spoke 18 and a canopy spoke spindle 20.

Figure 6:
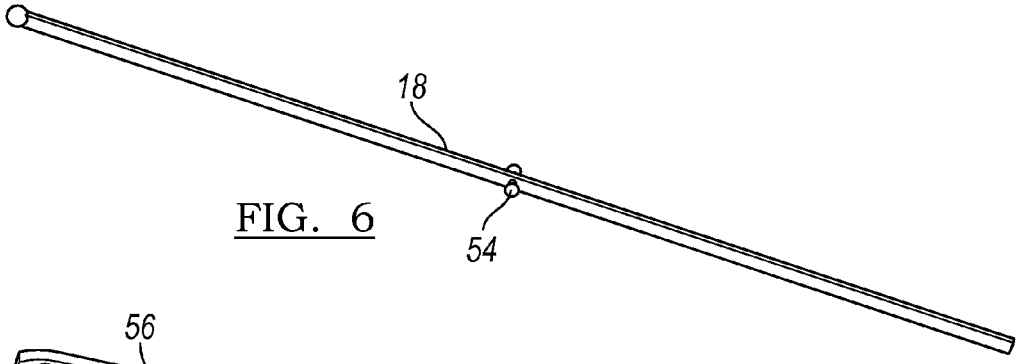
FIG. 6 is a drawing of a first variation of the canopy spoke of the umbrella of the preferred embodiment.

As shown in FIGS. 2 and 6, the canopy spokes 18 of the preferred embodiments function to support a portion of the canopy 16. The canopy spoke 18 of the preferred embodiments is preferably connected to the canopy 16 and to the main shaft 12. The canopy spoke 18 preferably extends from the main shaft to the furthest point of the canopy 16 and preferably has a rectangular or circular cross section, but may alternatively have any suitable cross section geometry, such as oval or flat. Additionally, the cross section may have different geometries along the length of the spoke. The canopy spoke 18 may be any suitable geometry and material to support a portion of the canopy 16.

Figure 3:
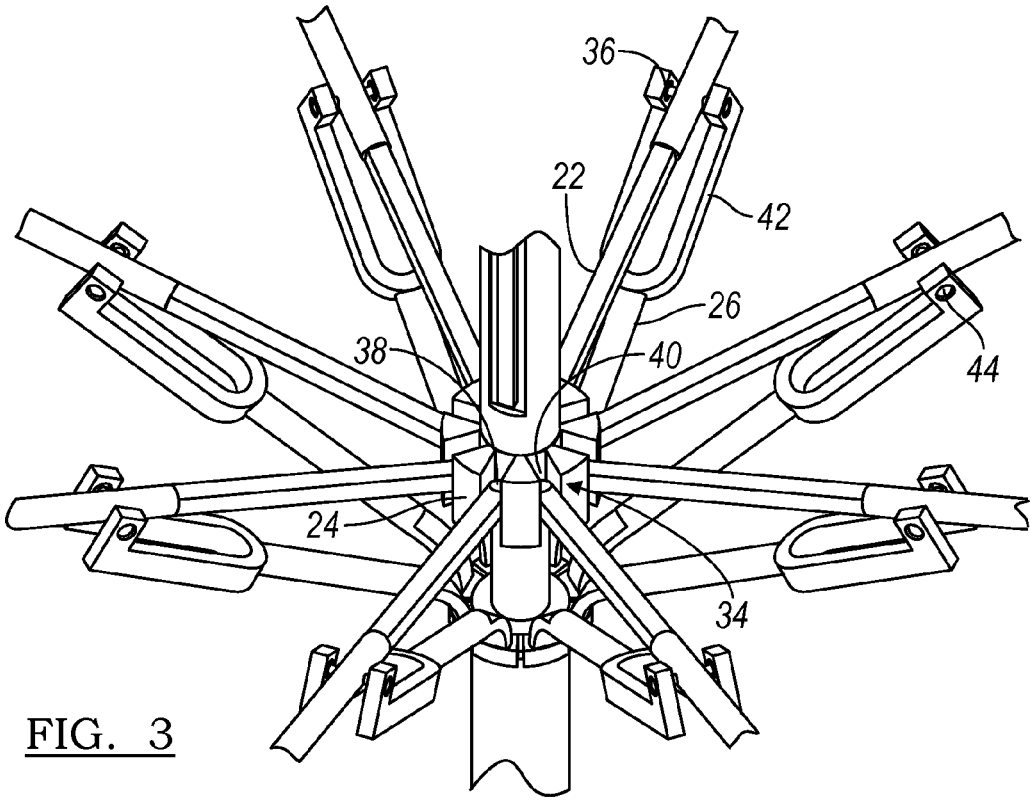
FIG. 3 is a drawing of a first variation of the first joint, second joint, and support spoke spindle of the umbrella of the preferred embodiment.

The canopy spoke spindle 20 of the preferred embodiments functions to couple at least one canopy spoke 18 to the main shaft 12. The canopy spoke spindle 20 is preferably fixed to the main shaft 12, but may alternatively slide along the main shaft 12. The canopy spoke spindle 20 is preferably connected to the main shaft 12 through a snap fit connection between the main shaft 12 and the canopy spoke spindle 20, but may alternatively connect to the main shaft 12 in any other suitable manner. The connection between the main shaft 12 and the canopy spoke spindle 20 is preferably removable for repair, upcycling, and/or recycling. The canopy spoke spindle 20 is preferably cylindrical, or semispherical, but may alternatively be any suitable geometry. The canopy spoke spindle 20 may include at least one of any suitable joint mechanism, hinge, or living hinge through which the canopy spoke 18 may connect. One such joint, as shown in FIG. 3, is a connector and socket joint 34, which functions to pivotably connect the canopy spoke 18 to the canopy spoke spindle 20. In this variation, the canopy spoke spindle 20 preferably includes at least one socket 40 and the canopy spoke 18 preferably includes a connector end 38 located at the portion of the canopy spoke 18 adjacent to the main shaft 12. The connector end 38 is preferably a spherical connector such that the connector and socket joint 34 resembles a conventional ball-and-socket joint. The connector end 38, however, may have any other suitable geometry. At least one of the connector end and the socket are preferably made of a resilient plastic. Additionally, the connector end 38 and the socket 40 are preferably coupled and uncoupled without the use of tools.

2b. Support Spokes

Figure 7:
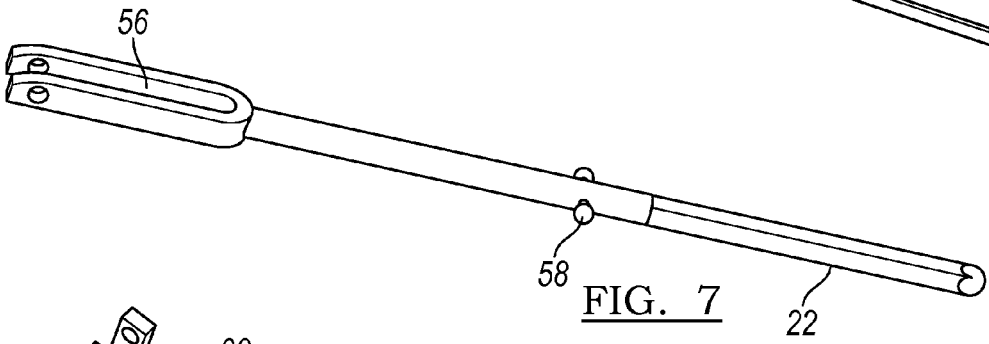
FIG. 7 is a drawing of a first variation of the support spoke of the umbrella of the preferred embodiment.

As shown in FIGS. 2 and 7, the support spoke system of the preferred embodiments functions to provide additional support to the spoke system 14 of the umbrella 10. The support spoke system includes at least one support spoke 22 and a support spoke spindle 24.

The support spokes 22 of the preferred embodiments function to provide additional support to a portion of the spoke system 14 of the umbrella 10. The support spoke 22 is preferably connected to the canopy spoke 18 and to the main shaft 12. The support spoke 22 preferably has a rectangular or circular cross section, but may alternatively have any suitable cross section geometry, such as oval or flat. Additionally, the cross section may have different geometries along the length of the spoke. The support spoke 22 may be any suitable geometry and material to provide additional support to the spoke system 14 of the umbrella 10. The support spoke 22 preferably connects to a central portion of the canopy spoke 18, but may alternatively connect to any suitable portion of the canopy spoke 18 or to any other suitable spoke in the spoke system 14. The support spoke 22 may connect to the canopy spoke 18 with any suitable joint mechanism, hinge, or living hinge. In a first variation, the support spoke 22 is connected to the canopy spoke 18 with a fork and pin joint 36, which functions to pivotably connect the support spoke 22 to the canopy spoke 18. In this variation, the support spoke 22 preferably includes a fork end 42 located at the portion of the support spoke 22 adjacent to the canopy spoke 18 and the canopy spoke 18 preferably defines a spoke pin 44, such that the canopy spoke 18 has at least one pin or nub protruding from the spoke as shown in FIG. 6. Alternatively, the canopy spoke defines a hole suitable for the insertion of a spoke pin 44. The spoke pin 44 or the hole for the spoke pin 44 is preferably located in a central portion of the canopy spoke 18, but may alternatively be located in any suitable portion of the canopy spoke 18. In this variation, the fork end couples to the spoke pin without the use of fasteners. The fork end and spoke pin are preferably coupled and uncoupled without the use of tools.

The support spoke spindle 24 of the preferred embodiments functions to couple at least one support spoke 22 to the main shaft 12. The support spoke spindle 24 is preferably slidably connected to the main shaft 12, but may alternatively be connected to the main shaft 12 in any suitable manner. As shown in FIG. 3, the support spoke spindle 24 preferably defines a hollow portion such that the support spoke spindle 24 fits around the main shaft 12 and may slide along the main shaft 12. The support spoke spindle 24 is preferably cylindrical, or semispherical, but may alternatively be any suitable geometry. The support spoke spindle 24 may include at least one of any suitable joint mechanism, hinge, or living hinge through which the support spoke 22 may connect. One such joint, as shown in FIG. 3, is a connector and socket joint 34, which functions to pivotably connect the support spoke 22 to the support spoke spindle 24. In this variation, the support spoke spindle 24 preferably includes at least one socket 40 and the support spoke 22 preferably includes a connector end 38 located at the portion of the support spoke 22 adjacent to the main shaft 12. The connector end 38 is preferably a spherical connector such that the connector and socket joint 34 resembles a conventional ball-and-socket joint. The connector end 38, however, may have any other suitable geometry. At least one of the connector end and the socket are preferably made of a resilient plastic. Additionally, the connector end 38 and the socket 40 are preferably coupled and uncoupled without the use of tools.

2c. Spring Spokes

Figure 8:
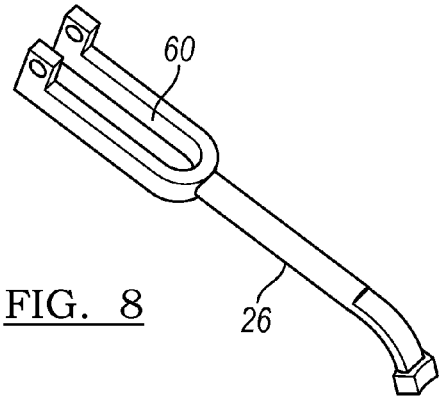
FIG. 8 is a drawing of a first variation of the spring spoke of the umbrella of the preferred embodiment.

As shown in FIGS. 2 and 8, the spring spoke system of the preferred embodiments functions to provide additional support to the spoke system 14 of the umbrella 10 and to provide a mechanism (and leverage) to open and close the umbrella 10. The spring spoke system includes at least one spring spoke 26 and a spring spoke spindle 28.

The spring spoke 26 of the preferred embodiments, which functions to provide additional support to a portion of the spoke system 14 of the umbrella 10 and to provide a mechanism to open and close the umbrella 10, is preferably connected to the support spoke 22 and to the main shaft 12. The spring spoke 26 preferably extends from the main shaft to the support spoke 22. The spring spoke 26 preferably connects to a central portion of the support spoke 22, but may alternatively connect to any suitable portion of the support spoke 22 or to any other suitable spoke in the spoke system 14. The spring spoke 26 may connect to the support spoke 22 with any suitable joint mechanism, hinge, or living hinge. One such joint, as shown in FIG. 3, is a fork and pin joint 36, which functions to pivotably connect the spring spoke 26 to the support spoke 22. In this variation, the spring spoke 26 preferably includes a fork end 42 located at the portion of the spring spoke 26 adjacent to the support spoke 22 and the support spoke 22 preferably defines a spoke pin 44, such that the support spoke 22 has at least one pin or nub protruding from the spoke as shown in FIG. 7. Alternatively, the support spoke defines a hole suitable for the insertion of a spoke pin 44. The spoke pin 44 or the hole for the spoke pin 44 is preferably located in a central portion of the support spoke 22, but may alternatively be located in any suitable portion of the support spoke 22. In this variation, the fork end couples to the spoke pin without the use of fasteners. The fork end and spoke pin are preferably snapped together without the use of tools.

The spring spoke 26 preferably has a rectangular or circular cross section, but may alternatively have any suitable cross section geometry, such as oval or flat. Additionally, the cross section may have different geometries along the length of the spoke. The mechanism to open and close the umbrella 10 of the spring spoke 26 of the preferred embodiments is preferably one of several variations. In a first variation, as shown in FIG. 2, the spring spoke 26 preferably has a variable cross section along its length. The variable cross section along the length of the spring spoke 26 permits the spring spoke 26 to function as a spring. The spring spoke 26 in this variation is in an unloaded, or equilibrium state, when the umbrella 10 is in an open position. As the umbrella 10 transitions to a closed position, and the spring spoke 26 is folded or bent, and the spring spoke 26 becomes loaded. Once the umbrella 10 is released from the closed position, the spring spoke 26 will unload and spring back to its unloaded state, returning the umbrella 10 to the open position. The mechanism to open and close the umbrella 10 of the spring spoke 26 of the preferred embodiments may alternatively be any other suitable mechanism to open and close the umbrella 10 such as a spring joint mechanism, hinge, or any other suitable mechanism. The umbrella 10 may also alternatively be transitioned from the open position to the closed position manually without the assistance of a mechanism. The spring spoke 26 may be any suitable geometry and material to provide additional support to a portion of the spoke system 14 of the umbrella 10 and to provide a mechanism to open and close the umbrella 10.

The spring spoke spindle 28 of the preferred embodiments functions to couple at least one spring spoke 26 to the main shaft 12. The spring spoke spindle 28 is preferably slidably connected to the main shaft 12, but may alternatively be connected to the main shaft 12 in any suitable manner. As shown in FIG. 2, the spring spoke spindle 28 preferably defines a hollow portion such that the spring spoke spindle 28 fits around the main shaft 12 and may slide along the main shaft 12. The spring spoke spindle 28 is preferably cylindrical, or semispherical, but may alternatively be any suitable geometry. The spring spoke spindle 28 may include at least one of any suitable joint mechanism, hinge, or living hinge through which the spring spoke 26 may connect. Alternatively, the spring spoke 26 may be connected to the spring spoke spindle 28 through a snap fit connection between the spring spoke 26 and the spring spoke spindle 28, but may alternatively connect to the spring spoke spindle 28 in any other suitable manner.

The spring spoke spindle 28 may also include geometry to correspond to the first latch 30 and second latch 32 of the main shaft 12 that functions to catch on the first latch 30 and second latch 32, such that the latches 30 and 32 function as anchors and hold the spring spoke spindle in place while the umbrella 10 is in the closed or open position. The geometry is preferably a hole, notch, or recess that corresponds to the button portion of the first latch 30 and second latch 32. The geometry may alternatively be any other suitable geometry to correspond to any variation of the first latch 30 and second latch 32.

The spring spoke spindle 28 may also further include a handle portion 52, as shown in FIG. 2. The handle portion 52 functions to provide a surface that may be held by a user to transition the umbrella 10 from the open position to the closed position and/or from the closed position to the open position. The handle portion 52 is preferably cylindrical, but may alternatively be any suitable geometry. The handle portion 52 may include a grip portion including at least one of a geometry (such as indents for fingers) and a second material (such as rubber) to facilitate gripping or moving by hand. The handle portion 52 may also be ribbed to provide comfort to the user, such as preventing clamminess in humid weather. The handle portion 52 is preferably made of recycled polypropylene plastic, but may be alternatively made from any plastic, metal, wood, or any other suitable material.

2d. Connectors

As shown in FIG. 3, the connector and socket joint 34 of the preferred embodiments functions to pivotably connect a spoke to the spoke spindle. The connector and socket joint 34 includes a socket 40 and a connector end 38. The socket 40 is connected to, formed with, or coupled in any other suitable fashion to the spoke spindle. The connector end 38 is connected to, formed with, or coupled in any other suitable fashion to the spoke, and is located at the portion of the spoke adjacent to the main shaft 12. The connector end 38 is preferably a spherical connector such that the connector and socket joint 34 resembles a conventional ball-and-socket joint. The connector end 38, however, may have any other suitable geometry. The socket 40 and the connector end 38 are preferably separable to facilitate repair, upcycling, and/or recycling. At least one of the connector end and the socket are preferably made of a resilient plastic. Additionally, the connector end 38 and the socket 40 are preferably coupled and uncoupled without the use of tools.

The support spoke 22 may connect to the canopy spoke 18 with any suitable joint mechanism, hinge, or living hinge, and the spring spoke 26 may connect to the support spoke 22 with any suitable joint mechanism, hinge, or living hinge. Preferably, at least one of the canopy spoke and support spoke or the support spoke and the spring spoke are coupled via a release mechanism. In this variation, the canopy spoke preferably has a geometry that defines a canopy coupling element 54, the support spoke preferably has a geometry that defines a support coupling element 56, and the first release mechanism includes the canopy coupling element 54 and the support coupling element 56. Additionally, the support spoke may further define a second support coupling element 58, the spring spoke has geometry that defines a spring coupling element 60; and the second release mechanism includes the second support coupling element 58 and the spring coupling element 60. The spoke system preferably includes at least one of the first release mechanism and the second release mechanism.

The first release mechanism operates in the following modes: joint mode, wherein the support coupling element 56 is coupled to the canopy coupling element 54 such that the support spoke and the canopy spoke are movable relative to one another; and release mode, wherein the support coupling element 56 is uncoupled from the canopy coupling element 54. The release mechanism transitions from joint mode to release mode in response to a force applied to the spoke system. The second release mechanism operates in a similar fashion described above however with the support spoke, second support coupling element 58, the spring spoke, and the spring coupling element 60.

The release mechanism preferably acts as a breakaway or emergency release mechanism such that upon experiencing a force the failure or break of the umbrella is designed to occur in the most easily repairable part of the structure. For example, the force may applied to the canopy (and transmitted to the spoke system via the canopy) by a gust of wind, or may be applied to the coupling elements by a user disassembling the umbrella. The release mechanism preferably functions as a joint with at least one degree of freedom (joint mode) until the point where the coupling elements receive a force that is large enough to release the mechanism (release mode), but not large enough to plastically deform any elements of the umbrella. A force that is large enough to plastically deform any element of the umbrella is defined as a destructive force. The force experienced by the coupling elements such that they disassemble is a substantially tensile force.

By releasing the coupling elements before plastic deformation, the geometry and material properties of the coupling elements are preserved such that they can be easily reassembled, preferably without the use of tools or fasteners. In other words, the geometries and material properties of the canopy spoke, the support spoke, and/or the spring spoke in joint mode are substantially equal to the geometries of the canopy spoke, the support spoke, and/or the spring spoke, respectively, in release mode. At least one of the coupling elements are preferably made of a resilient plastic such that they can flex, elastically change shape, or move in any other suitable fashion to uncouple, and then once uncoupled, will return to their original geometry. The coupling elements can be reassembled and the umbrella repaired by applying (preferably by a user) a force to the coupling elements. Due to the geometry of the coupling elements and the preferably resilient elastic material, the force required to couple the elements is substantially a compressive force and is less than the destructive force.

As shown in FIG. 2, the fork and pin joint 36 includes a fork end 42 and a spoke pin 44. The spoke pin 44 of the preferred embodiments functions to pivotably connect to the fork end 42. The fork end 42 is connected to, formed with, or coupled in any other suitable fashion to the first spoke towards the end portion of the first spoke. The spoke pin 44 is preferably formed with, but alternatively connected to or coupled in any other suitable fashion to the second spoke, and is preferably located in a central portion of the second spoke, but may alternatively be located in any suitable portion of the second spoke. The fork end 42 and the spoke pin 44 are preferably separable to facilitate repair, upcycling, and/or recycling. The fork end preferably couples to the spoke pin without the use of fasteners. The fork end and spoke pin are preferably snapped together without the use of tools.

2e. Spoke System Variation

The umbrella of an alternative variation is nearly identical to the umbrella 10 of the first variation. The difference between the two variations, however, is that at least one of the canopy spoke spindle, the support spoke spindle, and the spring spoke is an alternative variation. In this variation, a plurality of canopy spokes 18, support spokes 22, and/or spring spokes 26 are preferably connected to one another, rather than to a spoke spindle, and define a hollow portion such that they fit around the main shaft 12 and may be fixed to the main shaft 12 or may slide along the main shaft 12. The canopy spokes 18, support spokes 22, and/or spring spokes 26 in this embodiment preferably include any suitable joint mechanism, hinge, or living hinge located at the portion of the spoke located near the main shaft 12 such that the canopy spokes 18, support spokes 22, and/or spring spokes 26 may function as described above. This arrangement provides the additional benefit that it includes fewer parts and may further decrease assembly time and repair and recycling requirements.

3. Canopy

Figure 5:
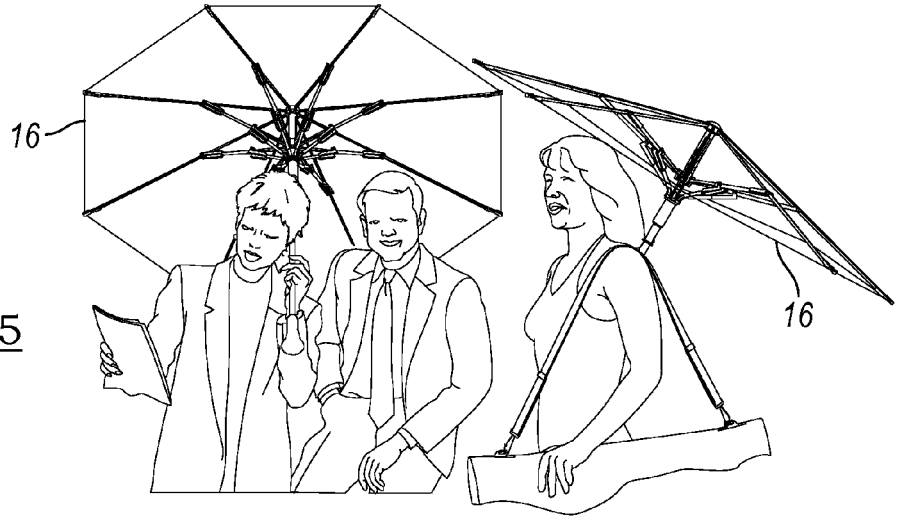
FIG. 5 is a drawing of a first variation of the canopy of the umbrella of the preferred embodiment.

The canopy 16 of the preferred embodiments functions to prevent the passage of precipitation or sun. As shown in FIG. 5, the canopy 16 is preferably generally oval or elliptically shaped. In this variation, if the umbrella 10 is held such that the major axis of the elliptical canopy 16 runs generally from in front of the user to behind them, the canopy 16 will protect both the user of the umbrella and an object, such as a backpack or purse, that they may have behind them or in front of them. The elliptical canopy 16 protects the user and their possessions from precipitation or sun while being narrow enough for the user to pass through crowded areas or narrow passages while the umbrella 10 is in the open position. Alternatively, if the umbrella 10 is held such that the major axis of the elliptical canopy 16 runs from the left side of the user to the right side of the user, the elliptical canopy 16 may easily cover two or more people. The canopy 16 may alternatively have any other suitable geometry, such as circular, non-circular, oval, rectangular, or polygonal. The canopy 16 is preferably of sufficient size to protect at least one user and their possessions and/or two users. The canopy 16 may alternatively be larger such as the size of a beach umbrella or smaller such that it may be easily portable.

Figure 4:
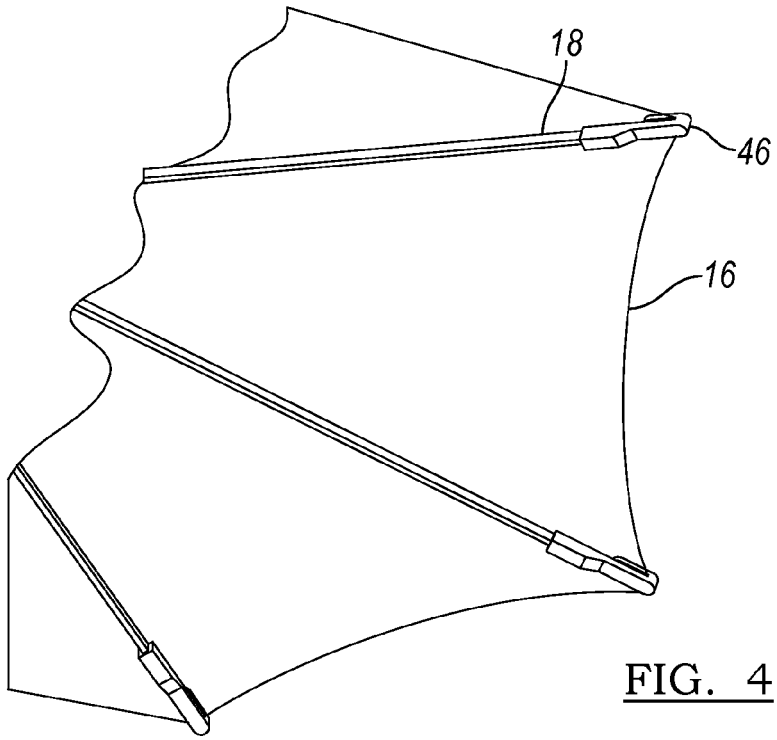
FIG. 4 is a drawing of a first variation of the canopy, canopy spoke, and canopy pin of the umbrella of the preferred embodiment.

The canopy 16 is preferably made of recycled polypropylene plastic, but may be alternatively made from any plastic, vinyl, fabric or any other suitable material. The material of the canopy 16 is preferably waterproof. Additionally, the material of the canopy 16 preferably requires minimal chemical waterproofing processes. The canopy 16 is preferably molded or heat sealed into shape, but may alternatively be shaped be any other suitable method such as cutting or sewing. As shown in FIG. 4, the canopy 16 is preferably connected to at least one canopy spoke 18 of the umbrella 10. The canopy 16 is preferably connects to a end portion of the canopy spoke 18, but may alternatively connect to any suitable portion of the canopy spoke 18 or to any other suitable spoke in the spoke system 14. Additionally, the canopy 16 may connect to a spoke in multiple locations. The canopy 16 may connect to the canopy spoke 18 with any suitable connection mechanism. The connection between the canopy 16 and the canopy spoke 18 is preferably removable for repair, upcycling, and/or recycling. One such joint, as shown in FIG. 4, includes a clamp with a first half and a second half. The first half has at least one canopy pin 46 and the second half defines holes that receive the canopy pins 46. The canopy is preferably placed between the two halves and the two halves are closed securing the canopy in place. The clamp is preferably coupled to or formed with the canopy spoke 18 or any other suitable spoke. The clamp, the canopy, and the spoke are preferably separable to facilitate repair, upcycling, and/or recycling. Additionally, the clamp, the canopy, and the spoke are preferably coupled and uncoupled without the use of tools.

An alternative variation includes a canopy pin 46, which functions to connect the canopy 16 to the canopy spoke 18. In this variation, the canopy spoke 18 preferably defines a hole suitable for the insertion of a canopy pin 46. The hole for the canopy pin 46 is preferably located in an end portion of the canopy spoke 18, but may alternatively be located in any suitable portion of the canopy spoke 18. The canopy 46 may be formed with or coupled to the canopy 18 in any suitable fashion. The canopy pin and the spoke are preferably separable to facilitate repair, upcycling, and/or recycling. Additionally, canopy pin and the spoke are preferably coupled and un-coupled without the use of tools.

The canopy pin 46 of the preferred embodiments functions to connect the canopy 16 to the canopy spoke 18. The canopy pin 46 is preferably one of several variations. In a first variation, as shown in FIG. 4, the canopy pin 46 preferably pierces the canopy 16 or is inserted through a hole defined by the canopy 16. Once inserted through the canopy 16, the canopy pin 46 is preferably inserted into the hole defined by the canopy spoke 18. The canopy pin 46 is then preferably heat-sealed or ultrasonic-sealed in place in the canopy spoke 18. The canopy pin 46 may alternatively be pressed into the hole defined by the canopy spoke 18 and be held in place by friction. The canopy pin 46 may alternatively be held in the hole defined by the canopy spoke 18 in any other suitable fashion, such as through a snap fit. The canopy pin 46 may alternatively be molded into or fixed in any other suitable fashion to the canopy spoke 18 rather than being a separate part.

4. Optional Elements

The umbrella 10 of the preferred embodiment also includes a handle 48, which functions to provide a surface that may be held by a user of the umbrella 10. The handle 48 is preferably cylindrical with an elliptical (or generally non-circular) end portion, but may alternatively be any suitable geometry. The major axis of the elliptical end portion is preferably aligned with the major axis of the elliptical canopy 16 such that the user may orient the canopy 16 by orienting the handle 48 rather than having to look up at the canopy 16 directly. The handle 48 may include a grip portion including at least one of a geometry (such as indents for fingers) and a second material (such as rubber) to facilitate gripping or moving by hand. The grip portion is also preferably ribbed to provide comfort to the user, such as preventing clamminess in humid weather. The handle 48 is preferably made of recycled polypropylene plastic, but may be alternatively made from any plastic, metal, wood, or any other suitable material. The handle 48 is preferably mechanically connected to the main shaft 12 through a snap fit, press fit, or though any other suitable connection. The handle 48 is preferably removable for repair, upcycling, and/or recycling.

The umbrella 10 of the preferred embodiments may further include a cap 50 that functions provide an additional connection point for the canopy 16 to the main shaft 12 of the umbrella 10 and may additionally provide a mechanism for securing the canopy spoke to canopy spoke spindle couplings. The cap 50 is preferably made of recycled polypropylene plastic, but may be alternatively made from any plastic, metal, wood, or any other suitable material. The cap 50 is preferably mechanically connected to the main shaft 12 through a snap fit, press fit, or though any other suitable connection. The cap 50 is preferably removable for repair, upcycling, and/or recycling.

5. Variations

The umbrella 10 may alternatively be a small, travel umbrella. In this variation, the spoke system may include additional joint and spoke components such that the umbrella may fold smaller to be suitable for travel. In this variation, the main shaft 12 may have at least one joint such that the main shaft 12 may telescope, compress, or fold to a smaller size. Alternatively, the umbrella 10 may be a large, beach umbrella. In this variation, the spoke system may include additional joint and spoke components such that the umbrella may support a larger canopy 16.

Although omitted for conciseness, the preferred embodiments include every combination and permutation of the various umbrellas 10, main shafts 12, spoke systems 14, and canopies 16.

As a person skilled in the art will recognize from the previous detailed description and from the figures and claims, modifications and changes can be made to the preferred embodiment of the invention without departing from the scope of this invention defined in the following claims.

We claim:

1. An umbrella comprising:

a shaft:

a canopy; and a spoke system, coupled to the shaft and to the canopy, that supports the canopy and provides a mechanism to open and close the canopy;

wherein the spoke system includes:

a canopy spoke spindle removably coupled to the shaft;

a canopy spoke, coupled to the shaft and to the canopy that includes a canopy spoke shaft with two ends with one end having a ball geometry that couples to the canopy spoke spindle, and that defines a canopy spoke pin located substantially in a central portion of the canopy spoke shaft, wherein the canopy spoke is a unitary piece;

a support spoke spindle removably coupled to the shaft that slides along the shaft;

a support spoke, coupled to the shaft and the canopy spoke, that includes a support spoke shaft with two ends, the first end having a fork geometry that is rotatably coupled to the canopy spoke pin, and the second end having a ball geometry that couples to the support spoke spindle, and that defines a support spoke pin located substantially in a central portion of the support spoke shaft, wherein the support spoke is a unitary piece;

a first release mechanism that includes the fork geometry of the support spoke and the canopy spoke pin;

wherein the first release mechanism operates in the following modes:

a. joint mode wherein the fork geometry of the support spoke and the canopy spoke pin are coupled such that the support spoke and the canopy spoke pivot relative to one another; and b. release mode wherein the fork geometry of the support spoke and the canopy spoke pin are uncoupled;

wherein a first force decouples a coupled fork geometry of the support spoke and canopy spoke pin of the joint mode into the release mode; and wherein the geometries of the canopy spoke and the support spoke in joint mode are substantially equal to the geometries of the canopy spoke and the support spoke, respectively, in release mode.

2. The umbrella of claim 1 wherein the geometry of the fork geometry and the geometry of the canopy spoke pin cooperatively define the magnitude of a second force that recouples a decoupled fork geometry and canopy spoke pin of the release mode into the joint mode to reassemble the first release mechanism.

3. The umbrella of claim 2 wherein the magnitude of the second force as cooperatively defined by the geometry of the geometry of the fork geometry and the geometry of the canopy spoke pin is less than a destructive force wherein the destructive force plastically deforms at least one of the shaft, the canopy, the canopy spoke, and the support spoke.

4. The umbrella of claim 3 wherein the second force is applied to the first release mechanism by the user.

5. The umbrella of claim 3 wherein the magnitude of the second force is substantially in a compressive direction.

6. The umbrella of claim 1 wherein the spoke system is made of recycled polypropylene plastic.

7. The umbrella of claim 6 wherein at least one of the fork geometry and the canopy spoke pin are made of a resilient plastic.

8. The umbrella of claim 1 wherein the canopy spoke and the support spoke do not plastically deform in the transition between the joint mode and the release mode.

9. The umbrella of claim 1 wherein the canopy spoke spindle includes a socket, and wherein the ball geometry of the canopy spoke is pivotably coupled to the socket of the canopy spoke spindle.

10. The umbrella of claim 9 wherein at least one of the ball geometry of the canopy spoke and the socket of the canopy spoke spindle are made of a resilient plastic.

11. The umbrella of claim 1 wherein the support spoke spindle includes a socket, and wherein the ball geometry of the support spoke is pivotably coupled to the socket of the support spoke spindle.

12. The umbrella of claim 11 wherein at least one of the ball geometry of the support spoke and the socket of the support spoke spindle are made of a resilient plastic.

13. The umbrella of claim 12 wherein the spring geometry of the spring spoke is substantially of a flexible cantilever beam that is cantilevered to the spring spoke spindle and the spring spoke moves from loaded first position to an unloaded second position.

14. The umbrella of claim 13 wherein the spring spoke provides a mechanism to open and close the canopy, and the first position of the spring spoke holds the canopy in the closed position and the second position of the spring spoke holds the canopy in the open position.

15. The umbrella of claim 13 wherein the cross sectional geometry of the spring geometry of the spring spoke is of a thinner cross section than the other portions of the spring spoke shaft.

16. The umbrella of claim 12 wherein the canopy spoke, the support spoke, and the spring spoke do not plastically deform in the transition between the joint mode and the release mode.

17. The umbrella of claim 1 wherein the geometry of the fork geometry and the geometry of the canopy spoke pin cooperatively define the magnitude of the first force to transition from joint mode to release mode.

18. The umbrella of claim 17 wherein the magnitude of the first force as cooperatively defined by the geometry of the fork geometry and the geometry of the canopy spoke pin is less than a destructive force wherein the destructive force plastically deforms at least one of the shaft, the canopy, the canopy spoke, and the support spoke.

19. The umbrella of claim 18 wherein the magnitude of the first force is substantially in a tensile direction.

20. The umbrella of claim 19 wherein the first force is applied to the spoke system by the canopy as a result of a wind force.

21. The umbrella of claim 19 wherein the first force is applied to the spoke system by a user.

22. The umbrella of claim 1 wherein the canopy is of a substantially oval shape.

23. An umbrella comprising:

a shaft:

a canopy; and a spoke system, coupled to the shaft and to the canopy, that supports the canopy and provides a mechanism to open and close the canopy;

wherein the spoke system includes:

a canopy spoke spindle removably coupled to the shaft;

a canopy spoke, coupled to the shaft and to the canopy, that includes a canopy spoke shaft with two ends, with one end having a ball geometry that couples to the canopy spoke spindle, and that defines a canopy spoke pin located substantially in a central portion of the canopy spoke shaft, wherein the canopy spoke is a unitary piece;

a support spoke spindle removably coupled to the shaft that slides along the shaft;

a support spoke, coupled to the shaft and the canopy spoke, having geometry that that includes a support spoke shaft with two ends, the first end having a fork geometry that is rotatably coupled to the canopy spoke pin, and the second end having a ball geometry that couples to the support spoke spindle, and that defines a support spoke pin located substantially in a central portion of the support spoke shaft, wherein the support spoke is a unitary piece;

a spring spoke spindle removably coupled to the shaft that slides along the shaft;

a spring spoke, coupled to the shaft and to the support spoke, that includes a spring spoke shaft with two ends, the first end having a fork geometry that is rotatably coupled to the support spoke pin, and the second end having a spring geometry that is coupled to the spring spoke spindle, wherein the spring spoke is a unitary piece;

at least one of a first release mechanism that includes the fork geometry of the support spoke and the canopy spoke pin and a second release mechanism that includes the fork geometry of the spring spoke and the support spoke pin;

wherein the first release mechanism operates in the following modes:

joint mode wherein the fork geometry of the support spoke and the canopy spoke pin are coupled such that the support spoke and the canopy spoke pivot relative to one another; and release mode wherein the fork geometry of the support spoke and the canopy spoke pin are uncoupled;

wherein a first force decouples the coupled fork geometry of the support spoke and the canopy spoke pin of the joint mode into the release mode;

wherein the second release mechanism operates in the following modes:

joint mode wherein the fork geometry of the spring spoke and the support spoke pin are coupled such that the spring spoke and the support spoke pivot relative to one another; and release mode wherein the fork geometry of the spring spoke and the support spoke pin are uncoupled;

wherein a second force decouples the coupled fork geometry of the spring spoke and the support spoke pin of the joint mode into the release mode; and wherein the geometries of the canopy spoke, the support spoke, and the spring spoke in joint mode are substantially equal to the geometries of the canopy spoke, the support spoke, and the spring spoke, respectively, in release mode.

* * * * *